US008870668B2

(12) United States Patent
Keller et al.

(10) Patent No.: US 8,870,668 B2
(45) Date of Patent: Oct. 28, 2014

(54) INCLUSIVE ROTATING PLAY DEVICE

(75) Inventors: Thomas L. Keller, Buffalo, MN (US); Thomas W. Felber, Hutchinson, MN (US)

(73) Assignee: Landscape Structures Inc., Delano, MN (US)

( * ) Notice: Subject to any disclaimer, the term of this patent is extended or adjusted under 35 U.S.C. 154(b) by 116 days.

(21) Appl. No.: 13/588,073

(22) Filed: Aug. 17, 2012

(65) Prior Publication Data

US 2013/0045810 A1 Feb. 21, 2013

Related U.S. Application Data

(60) Provisional application No. 61/524,424, filed on Aug. 17, 2011.

(51) Int. Cl.
*A63G 1/00* (2006.01)
*A63G 13/06* (2006.01)

(52) U.S. Cl.
USPC ..... 472/1; 472/102; 472/104

(58) Field of Classification Search
CPC ..... A63B 19/04; A63B 22/18; A63G 1/00; A63G 1/12; A63G 1/16; A63G 1/18; A63G 9/00; A63G 31/00; A63G 31/16
USPC ..... 472/1, 14, 15, 19, 25, 102, 16, 40, 114
See application file for complete search history.

(56) References Cited

U.S. PATENT DOCUMENTS

| | | | | | |
|---|---|---|---|---|---|
| 3,210,075 | A | * | 10/1965 | Brookman et al. | 472/23 |
| 3,612,518 | A | * | 10/1971 | Bennett | 472/23 |
| 4,877,236 | A | * | 10/1989 | Shannon | 472/14 |
| 4,982,949 | A | * | 1/1991 | Ulferts | 472/19 |
| 5,795,235 | A | * | 8/1998 | Ullrich et al. | 472/14 |
| 6,402,627 | B1 | * | 6/2002 | Gordon | 472/114 |

* cited by examiner

*Primary Examiner* — Kien Nguyen
(74) *Attorney, Agent, or Firm* — Christopher L. Holt; Kelly, Holt & Christenson, PLLC

(57) ABSTRACT

Rotating inclusive play devices are provided. In certain embodiments, a rotating play device includes a stationary base, a rotatable portion, and a speed limiting device that connects the stationary base to the rotatable portion. The speed limiting device illustratively limits a rotational speed of the rotatable portion relative to the stationary base. The rotatable portion may have an elevated outer perimeter that includes recessed and raised portions. The speed limiting device may include a cranking mechanism and/or a piston mechanism.

17 Claims, 6 Drawing Sheets

INCLUSIVE ROTATING PLAY DEVICE

REFERENCE TO RELATED CASE

The present application claims the priority of provisional application Ser. No. 61/524,424, filed on Aug. 17, 2011, the content of which is hereby incorporated by reference in its entirety.

BACKGROUND

A great variety of different play devices have been created. Multiple play devices are sometimes used together to form a play area for children. These play areas can include devices such as slides, swings, monkey bars, see-saws, jungle gyms, etc. Alternatively, a single play device may be used by itself without being part of a larger group of devices. Accordingly, play devices can be incorporated into a wide variety of settings.

One category of play devices includes rotating play devices. One well-known example is a "merry-go-round." Merry-go-rounds commonly include a top platform that supports one or more children. The top platform is connected to the ground through a rotatable joint that enables the top platform to spin. Children can then use their own power or be pushed to spin around in circles for their entertainment. Obviously, rotating play devices are not however limited to any particular setting or features, and can be used in any setting and include any features.

SUMMARY

An aspect of this disclosure relates to inclusive rotating play devices. In certain embodiments, a rotating play device includes a stationary base, a rotatable portion, and a speed limiting device that connects the stationary base to the rotatable portion. The speed limiting device illustratively limits a rotational speed of the rotatable portion relative to the stationary base. The rotatable portion may have an elevated outer perimeter that includes recessed and raised portions. The speed limiting device may include a cranking mechanism and/or a piston mechanism. These and various other features and advantages that characterize the claimed embodiments will become apparent upon reading the following detailed description and upon reviewing the associated drawings.

DETAILED DESCRIPTION

Embodiments of the present disclosure include rotating play devices. The devices may be used in environments such as in playgrounds for children. Embodiments are not however limited to any particular environment and may be used in any environment.

Figure 1:
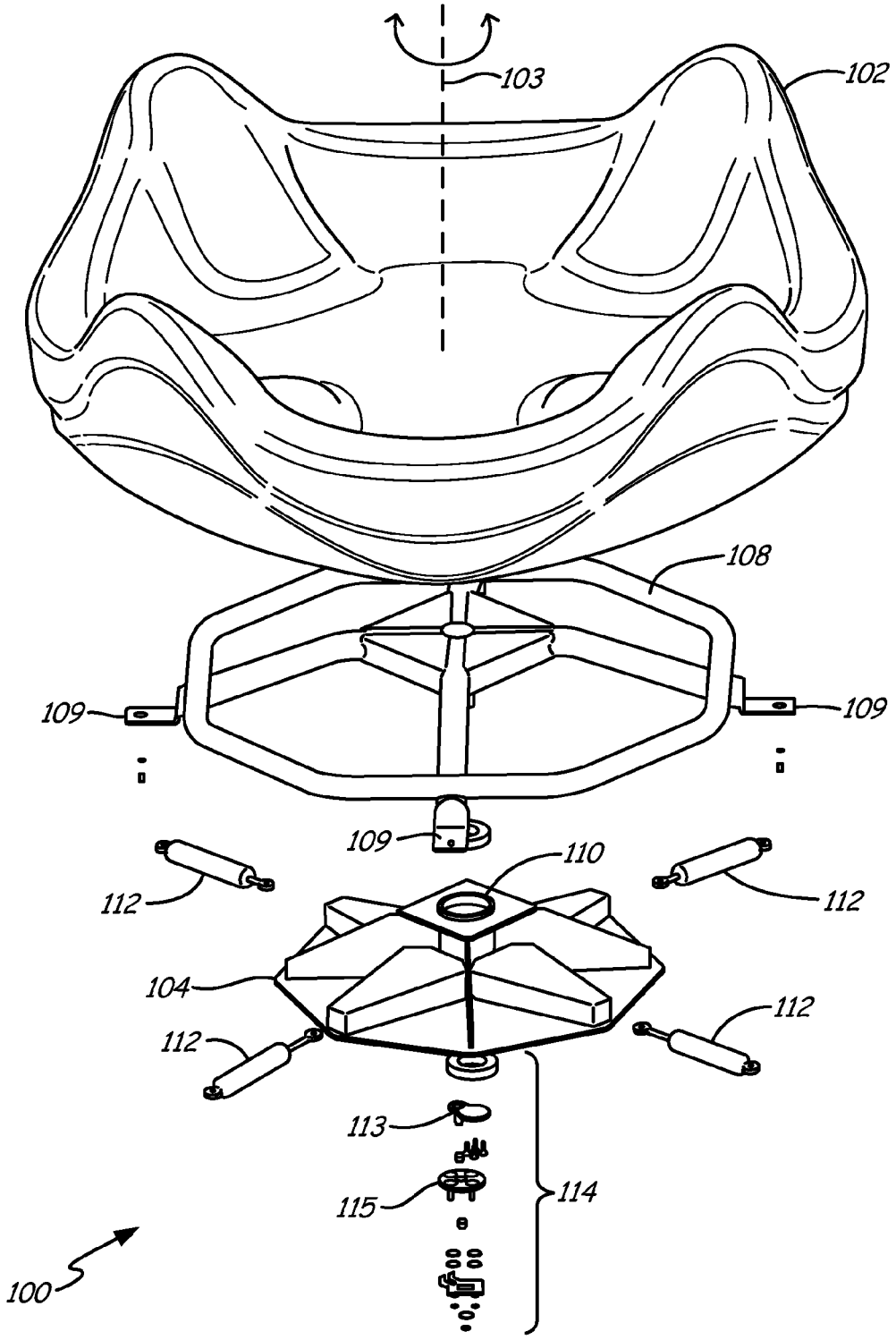
FIG. 1 is an exploded view of an inclusive rotating play device.

FIG. 1 shows an exploded view of a rotating play device 100. Device 100 includes a sitting and/or support structure 102 (hereinafter just "sitting structure" for simplification). As will be described in greater detail below, sitting structure 102 is rotatably mounted to a stationary base 104 such that sitting structure 102 is able to rotate about an axis of rotation 103. Sitting structure 102 illustratively provides a structure that is able to hold and support children as they are rotated about. Structure 102 is able to support children in a wide variety of ways (e.g. sitting upright or laying down). Structure 102 may also be useful in that it can used by children of all abilities, and is therefore inclusive rather than exclusive.

In one embodiment, sitting structure 102 is designed to allow for children to be able to easily access the structure and position themselves, while still being relatively contained within the structure during rotation. For instance, in the specific example shown in the figures, an outer perimeter of sitting structure 102 is angled up, or is elevated compared to the interior of the structure. This helps to keep children within the structure during rotation. It can also be seen from the figures that structure 102 also includes some portions of the outer perimeter that dip down or are recessed to allow for access.

Sitting structure 102 may be made from any material using any manufacturing method. In one embodiment, for illustration purposes only and not by limitation, it is made from a plastic and has a hollow interior. Such an embodiment can be made using a manufacturing method such as, but not limited to, rotational molding. Of course, embodiments are not limited to any particular construction or method of manufacturing.

Sitting structure 102 is illustratively attached to and supported by rotating support 108. Rotating support 108 optionally includes one or more attachment structures 109 that enable rotating support 108 to be securely attached to sitting structure 102 such that rotational motion from either element is transferred to the other element. In the specific example shown in the figure, attachment structures 109 include apertures such that screws or bolts may be used to attach support 108 to sitting structure 102. Embodiments are not however limited to any particular attachment scheme/configuration and may include any attachment scheme/configuration.

Rotating support 108 is illustratively attached to stationary base 104 at/through a speed limiting rotation point 110. In an embodiment, speed limiting rotation point 110 allows for sitting structure 102 to rotate, while at the same time providing some resistance to rotation. This may be advantageous in at least certain circumstances. For instance, in a traditional rotating play device (e.g. a "merry-go-round"), it may be possible to rotate children relatively quickly. This could in at least some situations be hazardous in that a child may not be able to support him or herself under the centripetal force and be thrown from the device. However, in at least some embodiments of the present disclosure, speed limiting rotation point 110 helps to reduce or control the speed at which sitting structure 102 can be rotated. This may help to reduce the likelihood of a child being thrown from the device.

In light of the above, it should be noted that rotating play device 100 has two features that may individually or in combination help to maintain children within the device while being rotated. The design/configuration of sitting structure 102 helps to contain children within the structure, and the speed limiting rotation point 110 helps to limit or control the speed. Some embodiments of the present disclosure, such as those shown in the figures, include both features. While other embodiments of the present disclosure only include one or the other feature. For instance, a sitting structure 102 that helps to contain children may be used without any type of speed limiting device, or a speed limiting device may be used with a more conventional "merry-go-round" support structure.

The resistance to rotational motion may be provided using any type of mechanisms or any methods. In the example shown in the figures, one or more speed limiting devices 112 are used. Speed limiting devices 112 may be mechanically driven (e.g. spring driven), pneumatically driven, electrically driven, some combination of mechanical/pneumatic/electrical, or any other type of device. Speed limiting devices 112 may be for instance a mechanical/pneumatic cylinder and piston arrangement such as those used to shut a screen door of a house, or a gas shock with fixed bearings. Rotating play device 100 may also include hardware 114 to support the rotation and to connect the various components. Two of the more important components are crank arm 113 and crank hub 115. These two components, as well as other aspects of speed limiting devices, are discussed in greater detail below.

Figure 2:
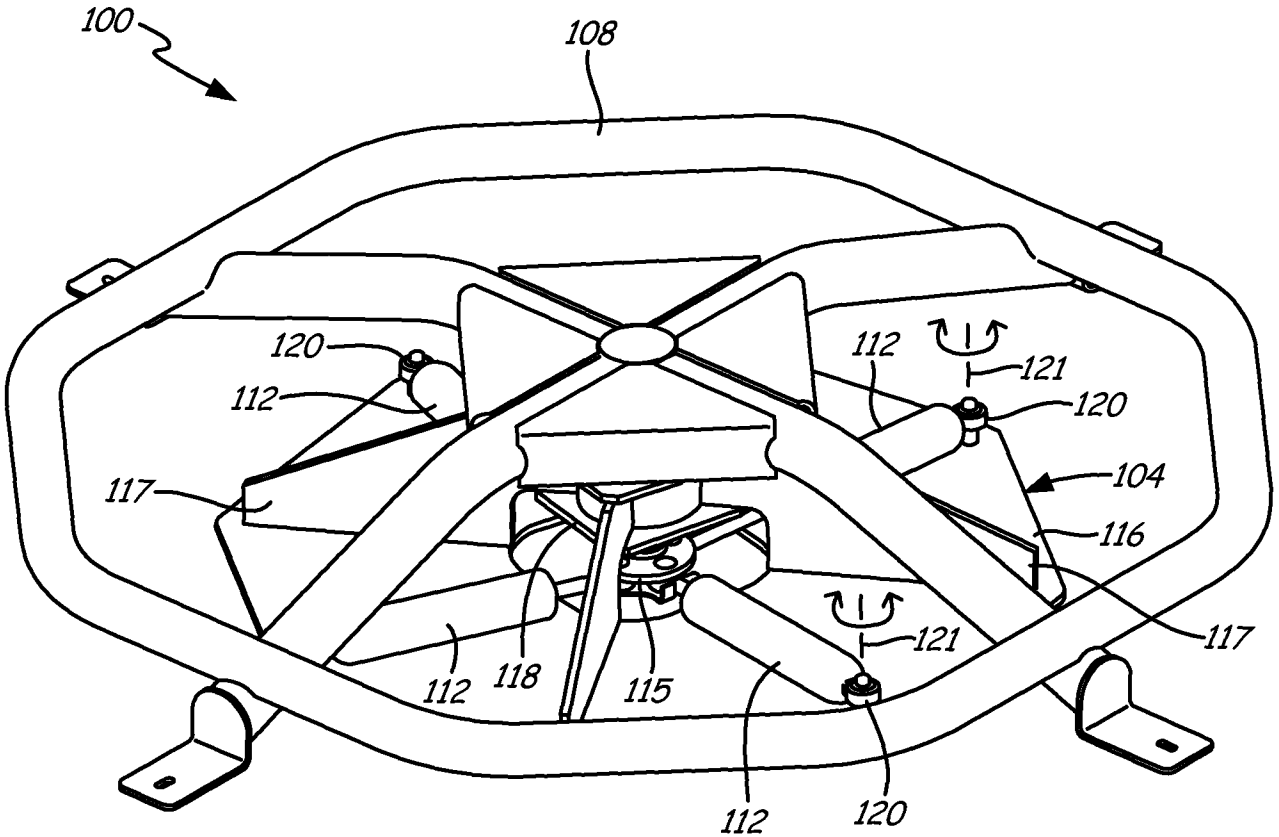
FIG. 2 is a perspective view of the top of a rotating play device with the sitting/support structure removed.

FIG. 2 is a top perspective view of an assembled rotating play device 100 with the sitting structure 102 (shown in FIG. 1) having been removed. FIG. 2 shows that stationary base 104 illustratively includes a bottom portion 116, one or more middle portions 117, and an upper portion 118 that is connected to bottom portion 116 though middle portions 117. One end of each speed limiting device 112 is optionally rotatably attached to an attachment point 120 of base bottom 116 such that the speed limiting device 112 is able to rotate about an axis of rotation 121. The other end of speed limiting device 112 is optionally rotatably attached to an attachment point on crank hub 115. Crank hub 115 illustratively translates motion or resistance to motion from the speed limiting devices 112 to the rotation support 108 (e.g. through a crank arm 113). The upper portion 118 of stationary base 104 may also have an assembly such as a bearing assembly that aids in translating motion.

Figure 3:
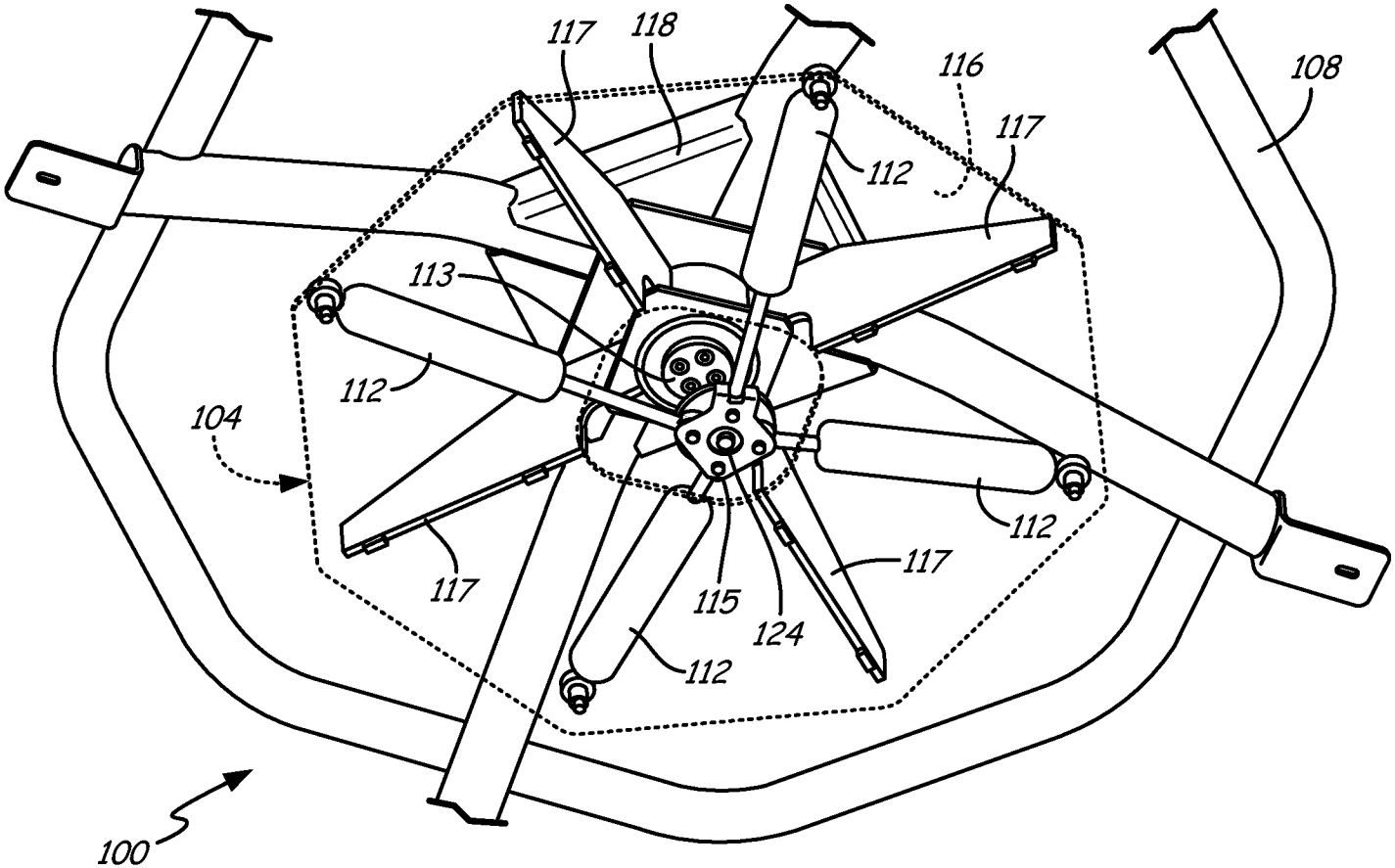
FIG. 3 is a perspective view of the bottom of a rotating play device with the sitting/support structure removed.

FIG. 3 is a bottom perspective view of an assembled rotating play device 100 with the sitting structure 102 (shown in FIG. 1) having been removed. FIG. 3 shows that crank hub 115 is rotatably connected to each of the speed limiting devices 112. Crank hub 115 has a rod 124 that is connected to the center of the crank hub 115 and that extends upward to connect the crank hub 115 to crank arm 113 that is within the upper portion 118 of the base 104. The crank arm 113 illustratively rotates along with the rotating support 108 and the sitting structure 102 (shown in FIG. 1). In an embodiment, rod 124 is connected to the crank arm 113 at an outer perimeter of the crank arm 113 (i.e. rod 124 is connected to crank arm 113 at a distance that is spaced apart from the center of rotation of crank arm 113). Accordingly, as crank arm 113 is rotated, rod 124 moves crank hub 115 which in turns extends or shortens the lengths of the speed limiting devices 112. Speed limiting devices 112 provide some resistance to the motion thus controlling or limiting the speed of an attached sitting structure 102.

Figure 4:
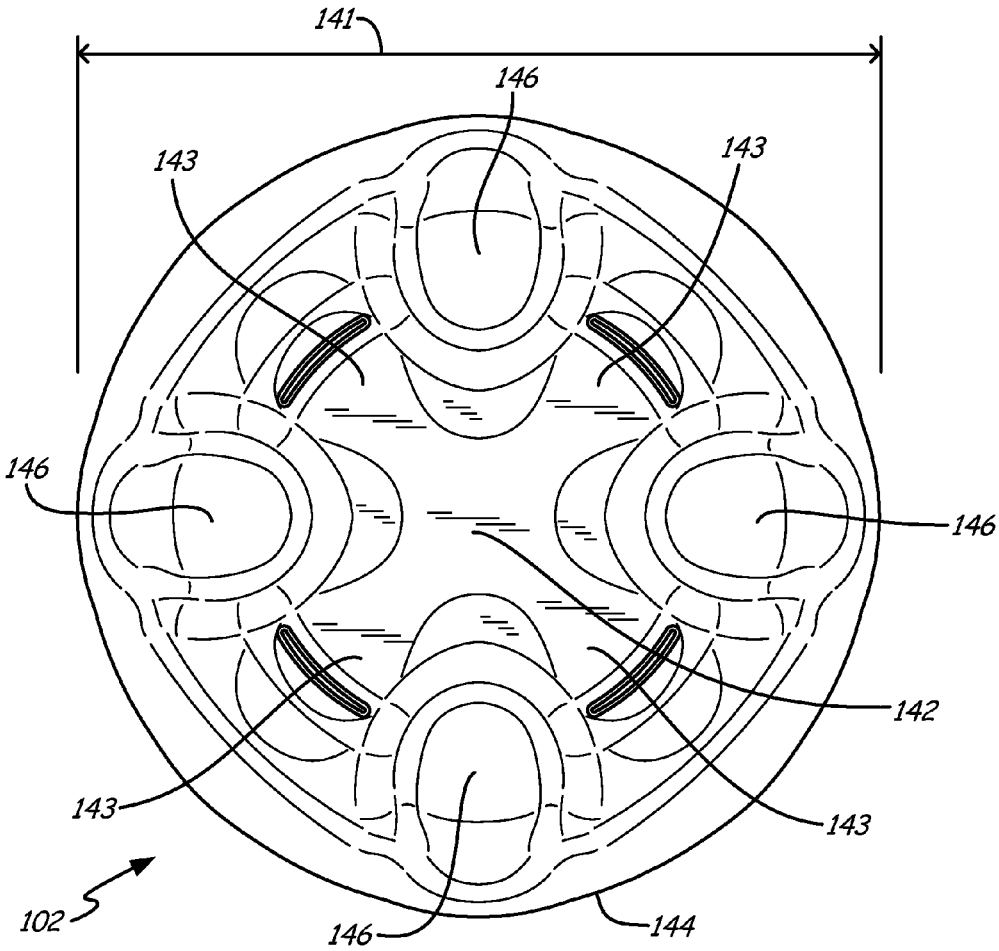
FIG. 4 is a top down view of a sitting/support structure.

FIG. 4 is a top down view of sitting structure 102. The specific sitting structure 102 shown in FIG. 4 is given merely for illustration purposes only. Embodiments of sitting structures may include any one or more features or combinations of features, and are not limited to the specific example shown in the figures.

Structure 102 may be approximately circular in shape and have a diameter 141. Diameter 141 is optionally between 60 and 100 inches in order to accommodate and provide appropriate room for multiple children. As previously mentioned, an outer perimeter 144 is illustratively elevated above an inner portion 142. This can be useful for keeping children from being thrown from the device. The inner portion 142 optionally includes extension portions 142 that separate built-in indented seats 146 from each other.

Figure 5:
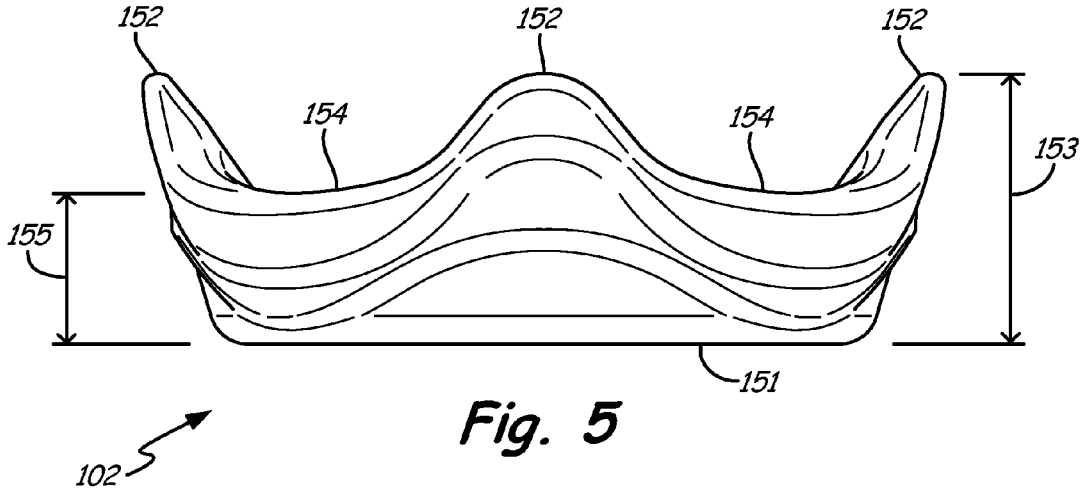
FIG. 5 is a side view of a sitting/support structure.

FIG. 5 is a side view of sitting structure 102. Structure 102 includes a bottom surface 151. The outer perimeter includes raised portions 152 and recessed portions 154. Raised portions 152 are at a height 153 from bottom surface 151, and recessed portions are at a height 155 from bottom surface 151. In an embodiment, height 153 is greater than height 155. Accordingly, the raised portions 152 can be used as a back rest or other support, while recessed portions 154 allow for easier access into and out of the sitting structure 102. It should be noted that both the raised portions 152 and recessed portions 154 are elevated compared to inner portion 142 (shown and labeled in FIG. 4). This may help to keep children from being thrown from the play device.

Figure 6:
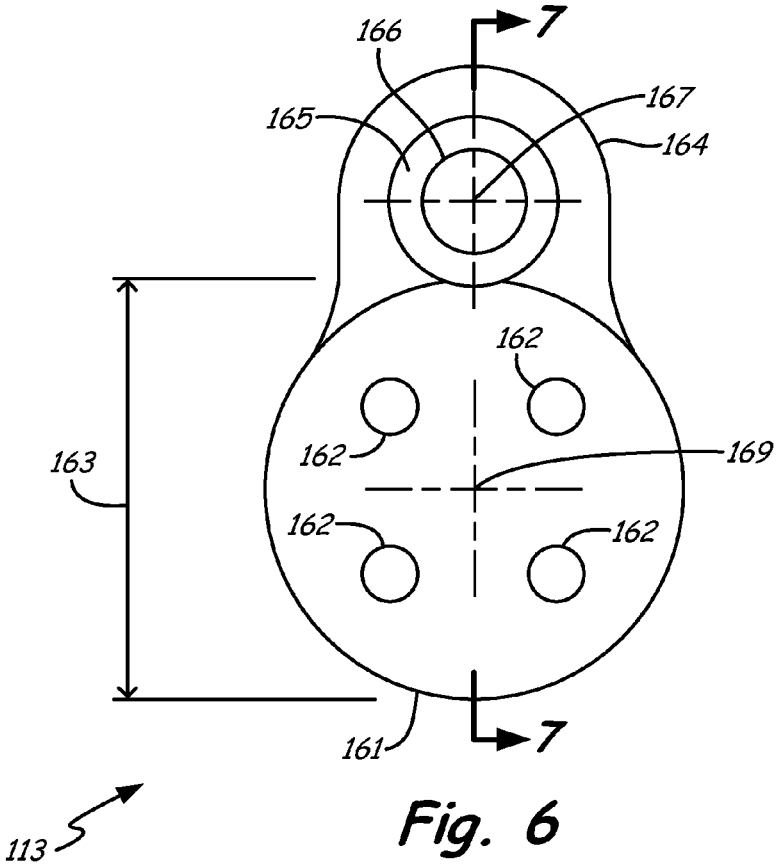
FIG. 6 is top down view of a crank arm.

FIG. 6 is a top down view of crank arm 113. Crank arm 113 includes a center portion 161 that may be approximately circular and have a diameter 163. Center portion 161 optionally includes one or more apertures 162 that can be used to connect crank arm 113 to rotating support 108 (shown and labeled in FIGS. 1 and 2). Crank arm 113 is illustratively connected to rotating support 108 in a fixed manner such that rotation of crank arm 113 is translated directly into rotation of rotating support 108. Crank arm 113 does not however need to have apertures 162. In other embodiments, crank arm 113 can be attached to rotating support 108 using any attachment means such as, but not limited to, clips, adhesives, magnets, welding, etc.

Crank arm 113 also includes an extension portion 164. Extension portion 164 includes a rod receiving aperture or section 165 that may include ball bearings, swivels, etc. In an embodiment, extension portion 164 connects crank arm 113 to a crank hub 115 utilizing a rod 166. Therefore, rotation of crank arm 113 is translated to crank hub 115 utilizing rod 166. As can be seen in the figure, a center of the crank/extension portion 167 is offset or separated from the center 169 of the main body portion of the crank arm. Therefore, it should be noted that crank arm 113 and crank hub 115 have axes of rotation that are offset from each other.

Figure 7:
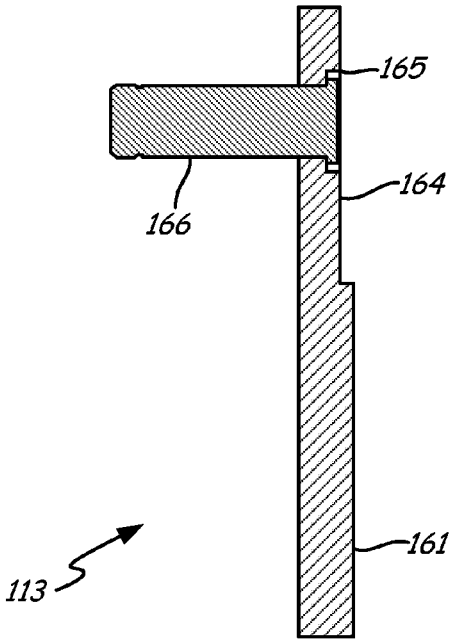
FIG. 7 is a side view of a crank arm.

FIG. 7 is a side view of crank arm 113 that includes a center portion 161 and an extension portion 164. The extension portion 164 optionally includes aperture 165 that can be used to support a rod 166. Rod 166 may include a top flanged portion that enables the rod 166 to rest in a recessed groove of aperture 165. This enables rod 166 to be able to rotate about its center axis while still being able to rotate center portion 161 about its center axis. Alternatively, crank arm 113 could include swivels, ball bearings, or any other mechanism that enables rod 166 to rotate relative to center portion 161.

Figure 8:
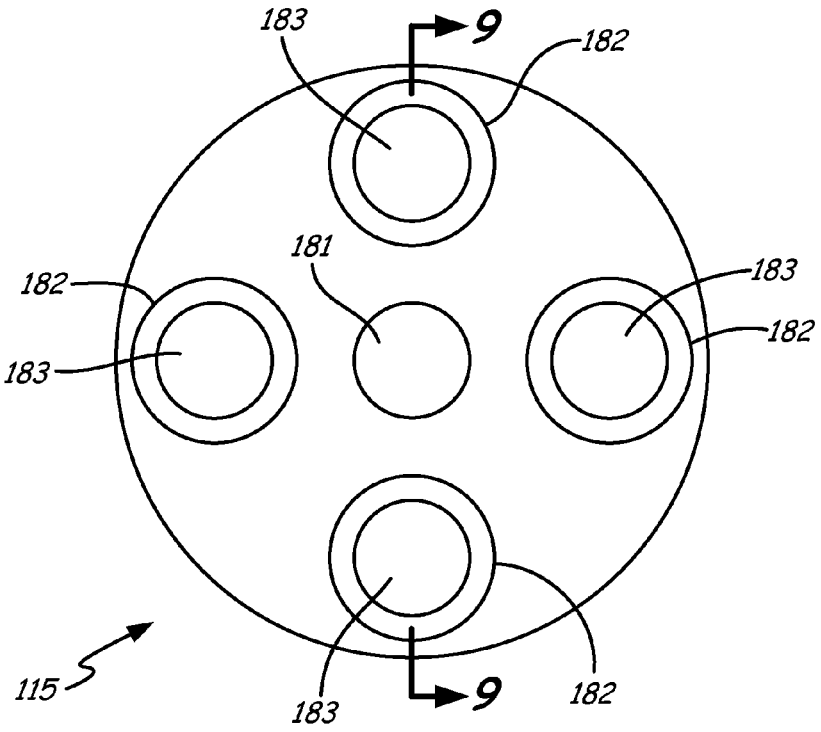
FIG. 8 is a top down view of a crank hub.

FIG. 8 is a top down view of crank hub 115. Crank hub 115 may be approximately circular and have a diameter 180. The center of crank hub 115 has an aperture 181 that is configured to connect to and support rod 166. Therefore, one end of rod 166 is connected to crank hub 115 and the other end of rod 166 is connected to crank arm 113 (shown and labeled in FIGS. 6-7).

Crank hub 115 also includes a number of satellite apertures 182 that surround center aperture 181. Satellite apertures are configured to connect to and support shafts 183. Shafts 183 are also configured to be attached to speed limiting devices 112 (shown and labeled in FIGS. 1 and 3). Therefore, crank hub 115 connects rod 166 to speed limiting devices 112, which limits the rotational speed of rod 166. This in turn limits the rotational speed of the upper sitting structure 102.

Accordingly, the above described mechanisms can be used to control the speed of an inclusive rotatable play device.

Figure 9:
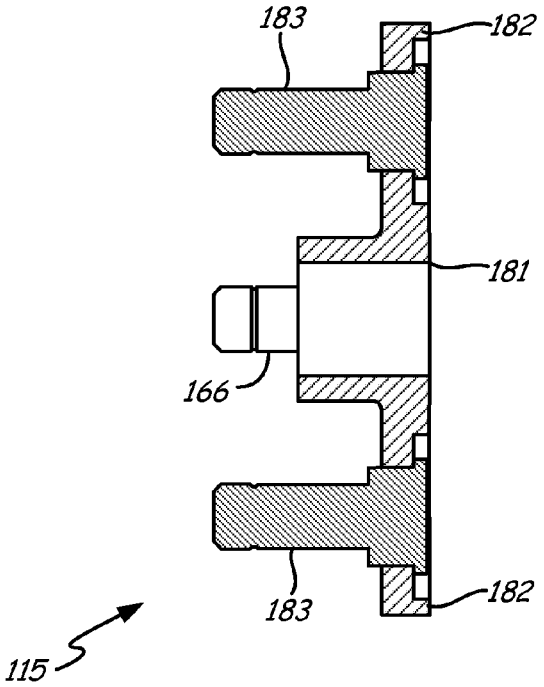
FIG. 9 is a side view of a crank hub.

FIG. 9 is a side view of crank hub 115. It shows that center aperture 181 can be used to connect the crank hub 115 to the rod 166, and that the satellite apertures 182 can be used to connect the crank hub 115 to the shafts 183. Similar to aperture 165 in FIG. 7, apertures 182 may also include a recessed ledge that is able to support a flanged portion of shafts 183. Accordingly, shafts 183 are able to be supported such that they are still able to rotate relative to the main body portion of crank hub 115.

Accordingly, as has been described above, embodiments of the present disclosure include rotating play devices. The rotating play devices may include one or more features that may be useful in reducing the likelihood of a child from being thrown from a rotating play device. For instance, play devices may include speed limiting devices that help to control or limit the rotational speed, and may additionally or alternatively include a sitting structure having a shape that helps contain children within the structure.

Finally, it is to be understood that even though numerous characteristics and advantages of various embodiments have been set forth in the foregoing description, together with details of the structure and function of various embodiments, this detailed description is illustrative only, and changes may be made in detail, especially in matters of structure and arrangements of parts within the principles of the present disclosure.

What is claimed is:

1. A rotating play device comprising:

a stationary base;

a rotatable portion, wherein the rotatable portion has an elevated outer perimeter that includes recessed portions and raised portions, and wherein the recessed and raised portions alternate along the elevated outer perimeter of the rotatable portion; and a speed limiting device that connects the stationary based to the rotatable portion.

2. The rotating play device of claim 1, wherein the speed limiting device comprises a gas shock.

3. The rotating play device of claim 1, wherein the speed limiting device comprises a set of mechanically driven braking devices.

4. The rotating play device of claim 3, wherein the recessed portions and raised portions further comprise seats.

5. The rotating play device of claim 1, and further comprising:

a cranking mechanism.

6. The rotating device of claim 5, wherein the cranking mechanism includes a crank arm.

7. The rotating device of claim 5, wherein the cranking mechanism includes a rod.

8. A rotating play device comprising:

a support structure with a perimeter that includes raised portions and recessed portions;

a stationary base; and a crank shaft that rotates the support structure about the stationary base, wherein the crank shaft is connected to a crank hub, and wherein the crank hub connects the crank shaft to a plurality of speed limiting devices utilizing rods.

9. The rotating play device of claim 8, and further comprising:

a speed limiting device that connects the crank shaft to the stationary base.

10. The rotating play device of claim 9, wherein the speed limiting device comprises a gas shock with fixed bearings.

11. The rotating play device of claim 8, wherein the crank shaft is offset from a center of rotation of the support structure.

12. The rotating play device of claim 8, wherein the support structure includes a sitting structure with an elevated outer perimeter, and wherein the elevated outer perimeter comprises seats for the sitting structure.

13. A method of rotating a play device comprising:

providing the play device, wherein the play device comprises a sitting structure with a seat;

limiting a rotational speed of the play device utilizing one or more speed limiting devices; and connecting a rotating portion of the play device to a stationary portion utilizing a plurality of rods.

14. The method of claim 13, and further comprising:

limiting the rotational speed utilizing a gas shock.

15. The method of claim 13, and further comprising:

rotating the play device utilizing a crank.

16. The method of claim 13, and further comprising:

rotatably connecting a crank hub to a crank arm.

17. The method of claim 13, and further comprising:

elevating an outer perimeter of the sitting structure of the play device.

* * * * *